US006926545B2

(12) United States Patent
Fukamachi et al.

(10) Patent No.: US 6,926,545 B2
(45) Date of Patent: Aug. 9, 2005

(54) ELECTRICAL CONNECTION BOX WITH A LOWER COVER FOR HOLDING AND MOUNTING A CONNECTOR

(75) Inventors: Makoto Fukamachi, Yokkaichi (JP); Yoshito Oka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 527 days.

(21) Appl. No.: 10/233,965

(22) Filed: Aug. 30, 2002

(65) Prior Publication Data

US 2003/0211764 A1 Nov. 13, 2003

(30) Foreign Application Priority Data

May 7, 2002 (JP) ..... 2002-131709

(51) Int. Cl.[7] ..... H01R 13/62
(52) U.S. Cl. ..... 439/157; 439/76.2; 439/949
(58) Field of Search ..... 439/157, 76.2, 439/949, 357, 347, 364

(56) References Cited

U.S. PATENT DOCUMENTS 5,788,529 A * 8/1998 Borzi et al. ..... 439/364
5,868,583 A * 2/1999 Naitou et al. ..... 439/76.2
5,934,926 A * 8/1999 Gabrisko et al. ..... 439/364
6,010,341 A * 1/2000 Matsuoka ..... 439/76.2
6,027,360 A * 2/2000 Jenkins ..... 439/364
6,126,458 A * 10/2000 Gregory et al. ..... 439/76.2

FOREIGN PATENT DOCUMENTS

JP 8-88920 4/1996

* cited by examiner

*Primary Examiner*—Hae Moon Hyeon
(74) *Attorney, Agent, or Firm*—Gerald E. Hespos; Anthony J. Casella

(57) ABSTRACT

An electric wire cover (60) is mounted on a lower portion of a housing (31) of a female connector (30). The electric wire cover (60) is accommodated inside a rectangular box-shaped connector-holding part (22) formed on a bottom wall (20A) of a lower cover (20), and an elastic piece (63) is interposed between the female connector (30) and the connector-holding part (22). Thus, the female connector (30) is supported for elastic displacement in a wait state. In consequence of mounting of the lower cover (20) on the body (11), the female connector (30) is connected to a connector connection part (13) of the body (11) of an electrical connection box. Thus in the case where there is a dislocation between the female connector (30) and the connector connection part (13), the female connector (30) shifts along the bottom wall (20A) of the lower cover (20), thus absorbing the dislocation.

11 Claims, 6 Drawing Sheets

ELECTRICAL CONNECTION BOX WITH A LOWER COVER FOR HOLDING AND MOUNTING A CONNECTOR

BACKGROUND OF THE INVENTION

1. Field of the Invention

The invention relates to an electrical connection box mounted on a vehicle or the like.

2. Description of the Related Art

Electrical connection boxes, such as junction boxes and relay boxes, often are mounted on a vehicle. A known electrical connection box has a body with a lower surface that has connection parts formed thereon. Electric components, such as relays, are mounted on the lower surface at the connection parts, and connectors at the ends of electric wires are connected to the components at the connection parts. The electrical connection box further has a lower cover with an electric wire port. The lower cover is installed on the body to cover the outside of the connector. An example of the electrical connection box of this kind is disclosed in Japanese Patent Application Laid-Open No. 8-88920.

The known electrical connection box is assembled so that the body of the electrical connection box and the lower cover are held close to each other. Connectors and the respective electric wires then are pulled out and connected to the body of the electrical connection box. Thereafter the lower cover is mounted on the body of the electrical connection box, while the electric wires are returned to the original positions. The assembling work has a low operability and low assembly efficiency.

The present invention has been made in view of the above-described situation. Accordingly, it is an object of the present invention to provide an electrical connection box that can be assembled with high operability.

SUMMARY OF THE INVENTION

The invention relates to an electrical connection box that has a body with upper and lower surfaces. A component-mounting portion is formed on the upper surface of the body, and is configured for mounting at least one electric part thereon. A connector connection part is formed on a lower surface of the body. A connector is provided at an end of an electric wire and is connectable to the connector connection part of the body. The electrical connection box further comprises a lower cover that can be mounted on the body. The lower cover is configured for covering a lower surface of the body and has a connector-holding part capable of holding the connector. This construction enables the connector to be placed in a wait state with the connector-holding part. The lower cover then is mounted on the body to connect the connector to the connector connection part.

An elastic member preferably is interposed between the connector and the connector-holding part to support the connector for elastic displacement.

An electric wire cover for laterally pulling out the electric wire preferably is mounted on a lower portion of a housing of the connector; and a bottom surface of the electric wire cover is allowed to slide on a bottom wall of the lower cover. The elastic member preferably is formed on a periphery of the electric wire cover so that the connector is elastically and displaceably supported along the bottom wall of the lower cover.

A guide means preferably is provided on the lower cover and the body for guiding an operation of mounting the lower cover on the body. Additionally, a connection between the connector and the connector connection part starts after the body and the lower cover are placed in position by the guide means.

The lower cover preferably has a peripheral wall with a height set to accommodate an entire connector mounted on the connector-holding part.

At least two of the connector connection parts preferably are disposed symmetrically on the lower surface of the body in a longitudinal direction of the body.

The female connector in the wait state is connected to the connector connection part of the body by mounting of the lower cover on the body. Thus, the lower cover can be mounted on the body with a high operability and efficiency.

Further, the elastic member supports the connector for elastic displacement. Both the body and the lower cover are large molded products. Thus, it is difficult to obtain a high precision in mounting the lower cover on the body, and there is a possibility that the connector and the connector connection part are dislocated from each other. However, according to the present invention, the connector shifts if there is a dislocation between the connector and the connector connection part and absorbs the dislocation. Therefore the lower cover can be mounted on the body easily.

The electric wire cover with the elastic piece is at the lower portion of the housing and slidably contacts the bottom wall of the lower cover. The connector in the wait state and the connector connection part may be dislocated from each other in mounting the lower cover on the body of the electrical connection box. However, the connector elastically shifts along the bottom wall of the lower cover to absorb the dislocation. Therefore the lower cover can be mounted on the body easily.

Connection between the connector and the connection part starts after the body of the electrical connection box and the lower cover are placed in position by the guide means. Therefore the connection between the connector and the connector connection part can be accomplished easily.

The connector does not project outside the lower cover when the connector is mounted on the connector-holding part of the lower cover. Thus the connector can be protected.

Two of the connector connection parts are disposed symmetrically disposed on the lower surface of the body of the electrical connection box. Therefore, it is possible to apply a uniform force to both connector connection parts during mounting to prevent the body from inclining longitudinally.

DETAILED DESCRIPTION OF THE PREFERRED EMBODIMENTS

Figure 1:
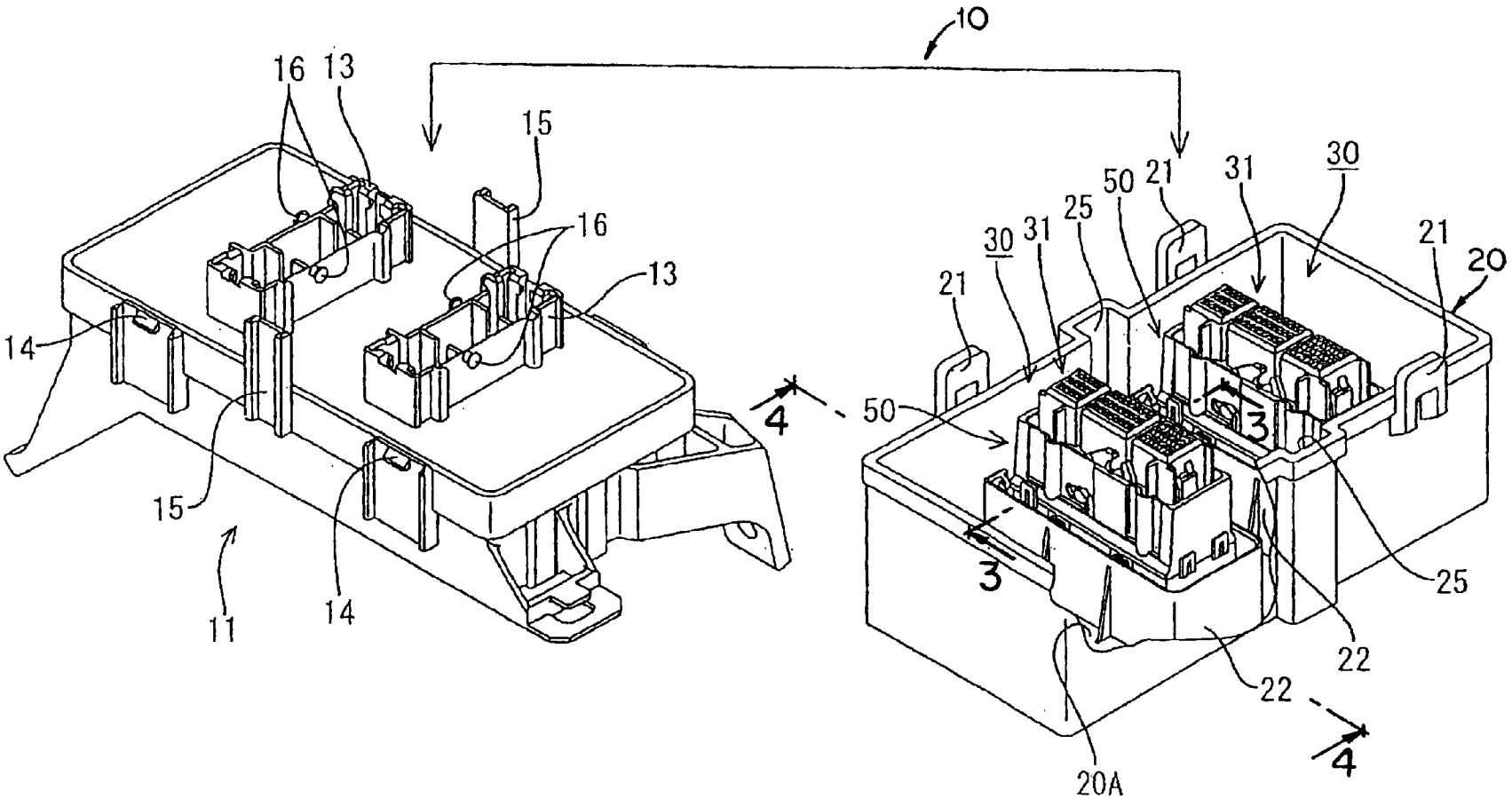
FIG. 1 is a partly broken away perspective view showing a state before a lower cover is mounted on the body of an electrical connection box according to an embodiment of the present invention.

An electrical connection box according to the invention is identified by the numeral 10 in FIG. 1. The connector 10 has a body 11, a lower cover 20 mounted on a lower surface of the body 11, and a female connector 30 mounted on the lower cover 20 and connected to the lower surface of the body 11.

As shown in FIG. 1, the body 11 of the electrical connection box 10 is substantially a solid flat rectangle that is long and narrow in a right-to-left direction. The body 11 has an upper surface with a plurality of part-mounting portions for mounting electric parts, such as relays and fuses. Right and left connector connection parts 13 are formed on the lower surface of the body 11, and the female connector 30 can be fit on the connector connection parts 13. The body 11 accommodates circuits composed of bus bars (not shown) layered one upon another. A portion of each bus bar projects into each connector connection part 13 and functions as a terminal (not shown).

Figure 2:
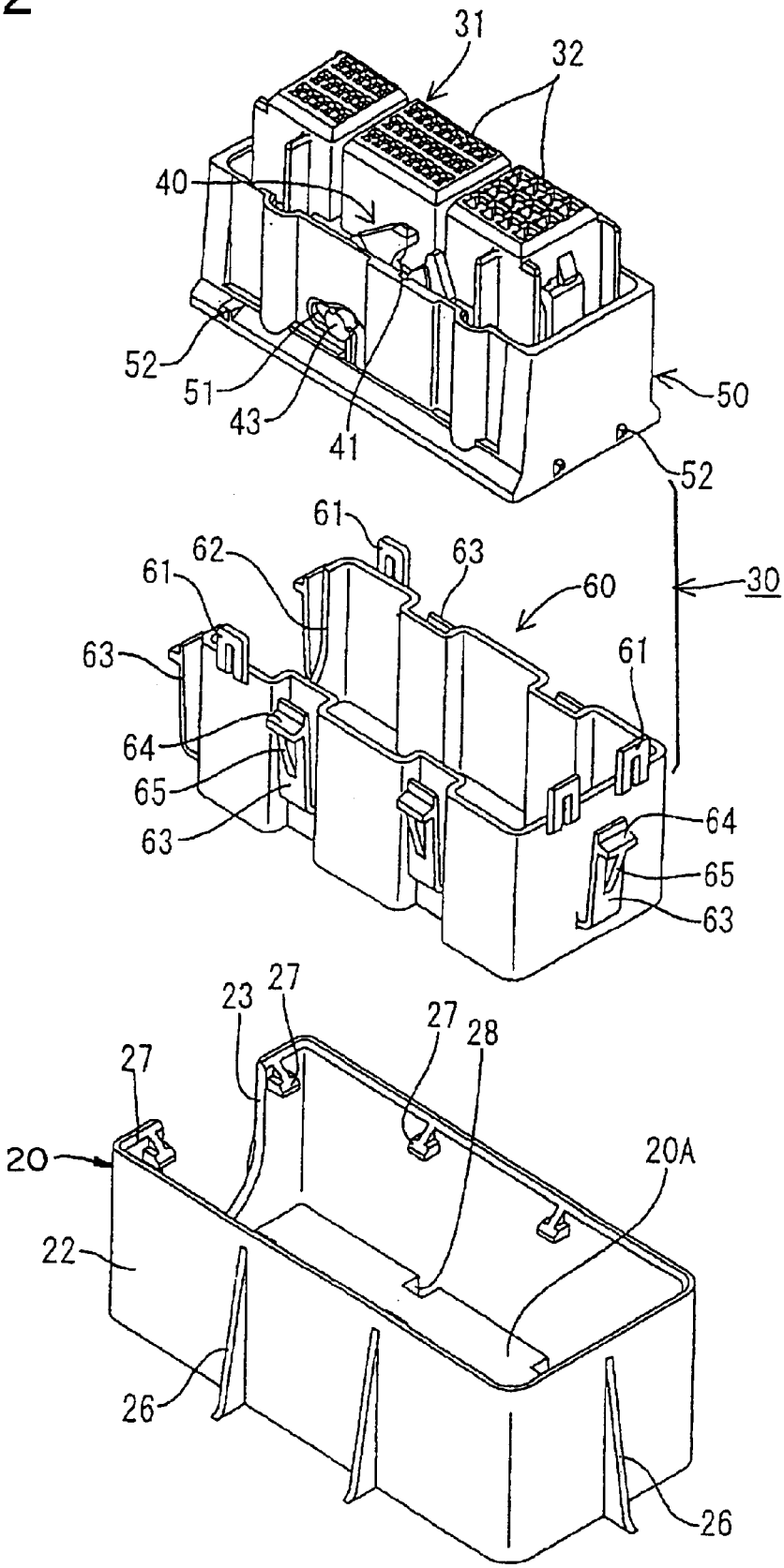
FIG. 2 is an exploded perspective view showing a female connector and a lower cover.
Figure 4:
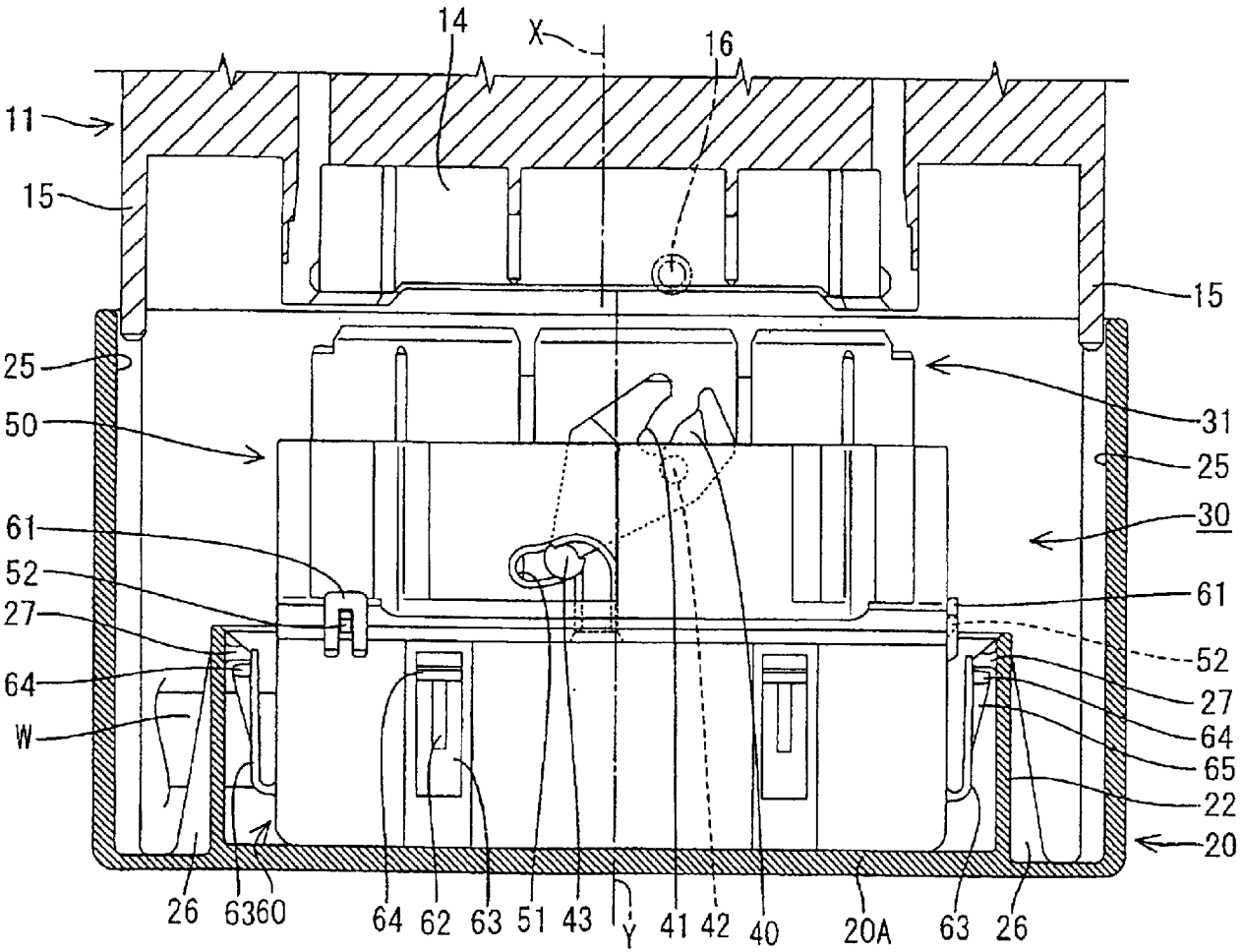
FIG. 4 is a side view partly in section showing a state before a connector connection part is connected to the female connector.

As shown in FIG. 1, the lower cover 20 is an upwardly open box that is long and narrow in the right-to-left direction. Two locking pieces 21 extend up from an upper end of each of a front wall and a rear wall of the lower cover 20. The locking pieces 21 are configured to be locked elastically with locking claws 14 formed respectively on front and rear surfaces of the body 11. Thus, the lower cover 20 can be mounted on the body 11, with the lower cover 20 covering the lower surface of the body 11. Guide ribs 15 project down from the widthwise center of the front and rear surfaces of the body 11, and positioning grooves 25 are formed on the front and rear walls of the lower cover 20. The guide ribs 15 can be inserted vertically into the corresponding guide grooves 25. As shown in FIGS. 2 and 4, right and left connector-holding parts 22 are formed on the upper surface of the bottom wall 20A of the lower cover 20. Each connector-holding part 22 is a long narrow rectangle that opens up. A large cut out 23 is formed in the widthwise center of the rear wall of each connector-holding part 22. The cutout 23 is formed to receive an electric wire W pulled out from the female connector 30 that will be described later. The electric wire W is led to the outside through an electric wire port (not shown) formed on the rear wall of the lower cover 20. One or two reinforcing portions 26 are formed integrally on each outer surface of the connector-holding part 22 for preventing the lower cover 20 from deforming. Slip-off prevention projections 27 project horizontally inward from the inner periphery of the connector-holding part 22, and are formed at positions aligned with the upper end of each reinforcing portion 26. Draw holes 28 are formed on the bottom wall 20A of the connector holding part 22 immediately below the slip-off prevention projections 27. The entire lower cover 20, including the connector-holding part 22, can be formed by molding a material in two dies (not shown) that open and close vertically. The height of the peripheral wall of the connector-holding part 22 is set to accommodate the entire female connector 30 held by the connector-holding part 22.

Figure 3:
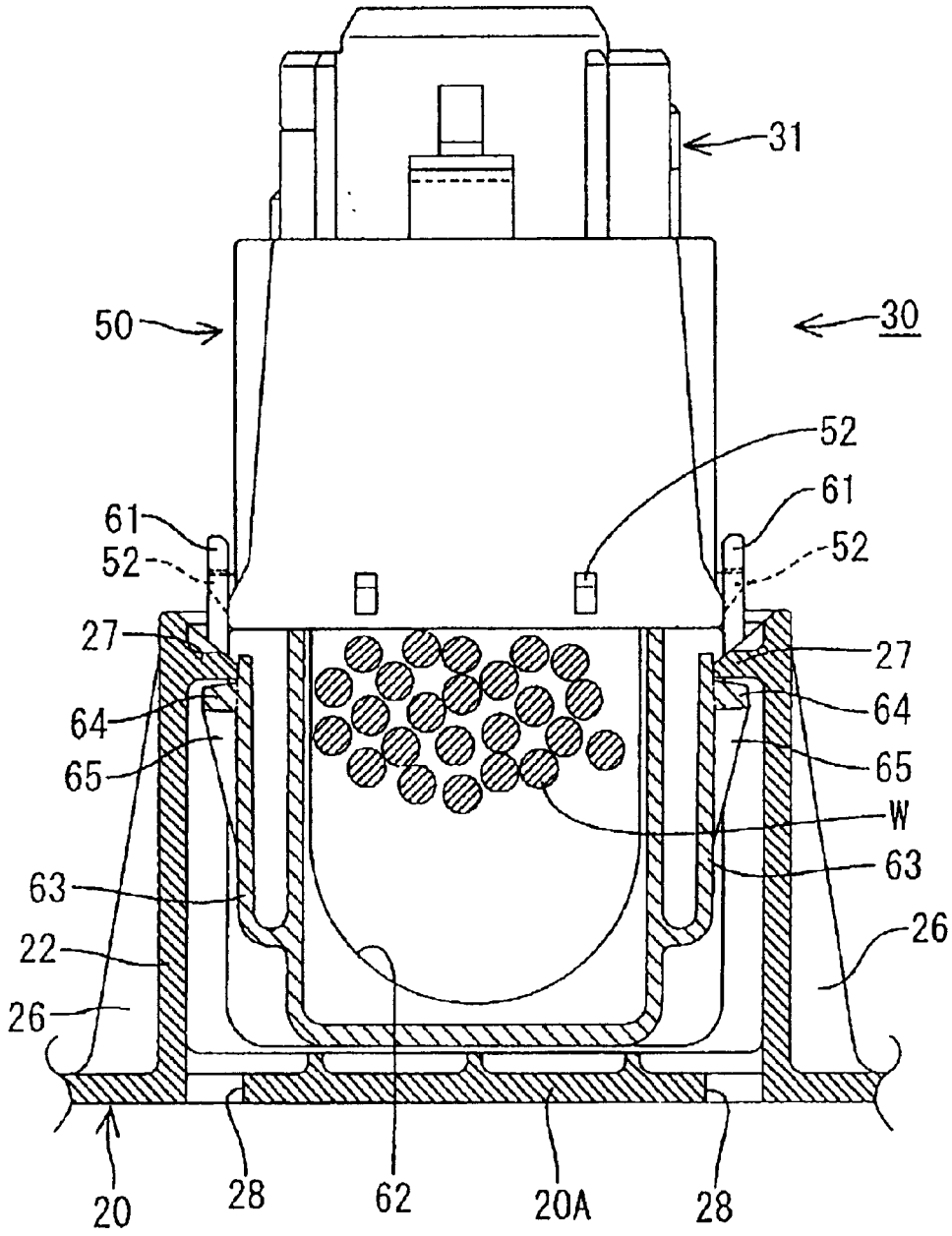
FIG. 3 is a front view partly in section showing a state in which the female connector has been mounted on the lower cover.

As shown in FIGS. 2 through 4, the female connector 30 has a female housing 31 in the shape of a block that is long and narrow in a front-to-back direction. The female connector 30 also has a rectangular box-shaped holder 50 that accommodates the female housing 31, and an electric wire cover 60 mounted on the lower part of the holder 50.

Figure 6:
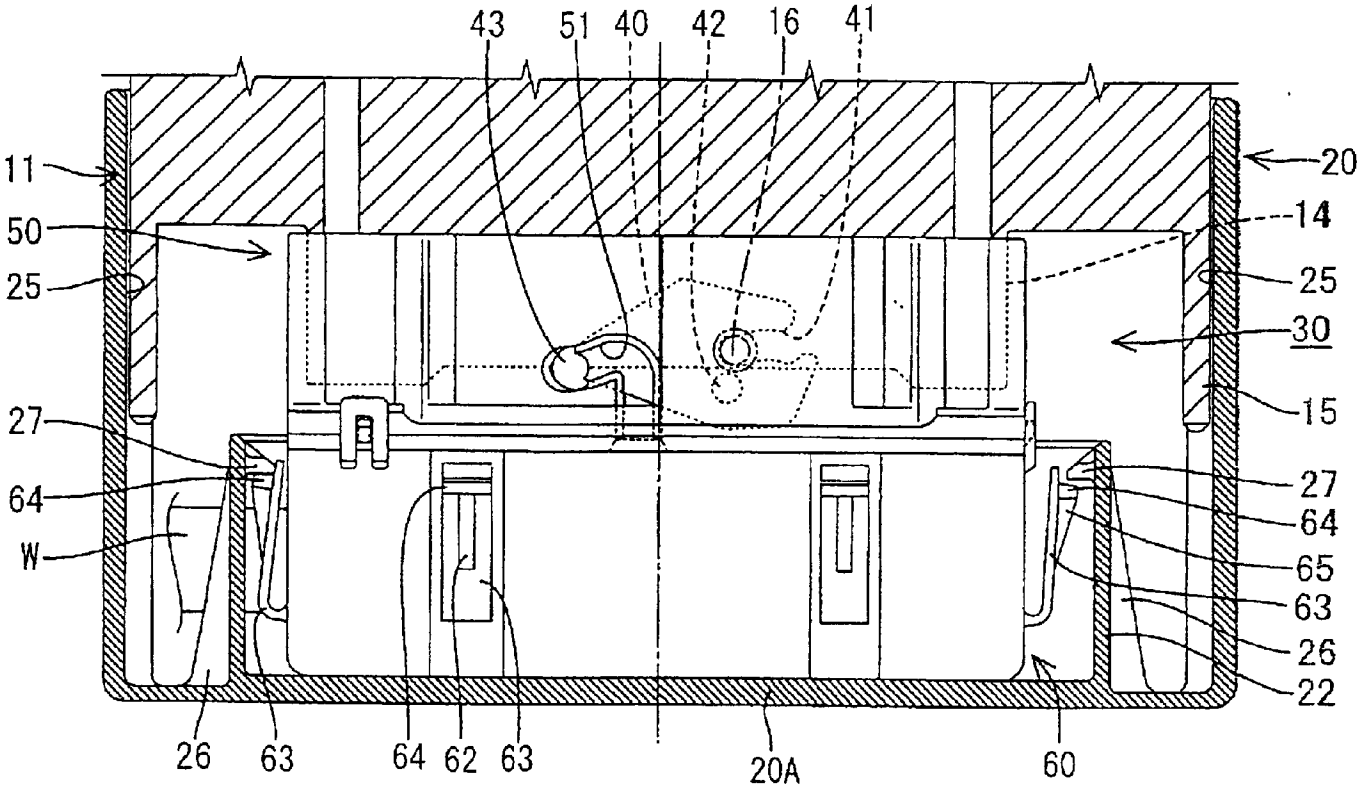
FIG. 6 is a side view partly in section showing a state in which the female connector and the connector connection part are normally connected with each other.

Cavities 32 are formed in the female housing 31 in a plurality of rows. A female terminal fitting (not shown) connected to a terminal of the electric wire W is inserted into each cavity 32 from below and accommodated therein. The female housing 31 is fit slidably in the holder 50 and can be held at a forward position (see FIG. 4) at which most of the female housing 31 projects out from the upper edge of the holder 50 and a rearward position (see FIG. 6) at which the female housing 31 is accommodated in the holder 50.

As shown in FIG. 4, the connector connection part 13 of the body 11 of the electrical connection box 10 has the shape of a hood that opens down. The female housing 31 of the female connector 30 can be fit in the connector connection part 13, and the holder 50 can be fit on the periphery of the connector connection part 13. As shown in FIG. 1, the connector connection parts 13 have almost the same configuration and are arranged symmetrically in the right-to-left direction. Terminals (not shown) project into the connector connection part 13 from positions on its bottom surface corresponding to the cavities 32 of the female connector 30.

Levers 40 are mounted on the opposed side surfaces of the female housing 31, and a curved cam groove 41 is formed on a side of each lever 40. A shaft 42 supports the lever 40 rotatably in such a way that the right and left sides of the lever 40 are symmetrical with respect to a certain point. A connection pin 43 is disposed on the end of the lever 40 opposite the cam groove 41 and is fit on a connection groove 51 of the holder 50 to connect the lever 40 and the holder 50 to each other. When the female housing 31 is held at the forward position, an entrance of the cam groove 41 of each lever 40 is open upward. Follower pins 16 extend from right and left side surfaces of the connector connection part 13 and can be fit in the cam grooves 41 of the levers 40.

The right and left follower pins 16 are disposed at the entrance of the cam groove 41 of the corresponding lever 40 when the connector connection part 13 is fit on the female housing 31 at the forward position. The connector connection part 13 can be pressed further into the holder 50 and presses the female housing 31 into the holder 50, while rotating the lever 40. Consequently the connector connection part 13 is moved toward the female housing 31 by the action of levers between the cam groove 41 and the follower pin 16. The female connector 30 and the connector connection part 13 fit normally on each other when the female housing is pressed to the rearward position.

The electric wire cover 60 is an upwardly open box that can be accommodated inside the connector-holding part 22 with a space between the electric wire cover 60 and the connector-holding part 22 in the front-to-back direction and the right-to-left direction. More specifically, the electric wire cover 60 is slidable in a predetermined range in the front-to-back direction and the right-to-left direction, with the bottom surface of the electric wire cover 60 in contact with the bottom wall 20A of the connector-holding part 22. Locking pieces 61 extend up from the upper end of the periphery of the electric wire cover 60 and can be locked to locking projections 52 formed at the lower end of the holder 50. Thus, the electric wire cover 60 can be mounted on the holder 50 in such a way as to cover almost the entire lower surface of the holder 50. An electric wire outlet 62 is formed centrally on the rear surface of the electric wire cover 60, and the electric wire W pulled out from the lower end of the female housing 31 is bent laterally (rearward) at the inner side of the electric wire cover 60 and pulled out to the outside from the electric wire outlet 62. Elastic pieces 63 are formed on each outer surface of the electric wire cover 60 at locations aligned with the respective slip-off prevention projections 27 of the connector holding part 22. Each elastic piece 63 is cantilevered upward from a lower portion of each wall surface of the electric wire cover 60 and is deformable toward the wall surface. A plate-shaped locking projection 64 projects from the outer surface of the leading (upper) end of the elastic piece 63 in the entire width thereof and can be locked beneath the corresponding slip-off prevention projection 64. A tapered rib 65 is formed at the widthwise center of the underside of the locking projection 64 and projects gradually lesser distances from the elastic piece 63 as the rib 65 extends toward the base side (lower side) of the elastic piece 63.

Initially the female housing 31 of the female connector 30 is accommodated in the holder 50 at its forward position. Each locking piece 61 of the electric wire cover 60 then is locked to the locking projection 52 of the holder 50 to hold the electric wire cover 60 on the lower portion of the holder 50. At this time, the electric wire W extends from the lower end of the female housing 31 is pulled out to the outside through the electric wire outlet 62 of the electric wire cover 60.

The holder 50 for the female connector 30 then is inserted from above into the connector-holding part 22 of the lower cover 20. As a result, each elastic piece 63 is pressed down into contact with the projected edge of the corresponding slip-off prevention projection 27, and the elastic pieces 63 deform elastically inward. The elastic pieces 63 restore elastically to their original state when the bottom surface of the electric wire cover 60 contacts the bottom wall 20A of the connector-holding part 22. Consequently the locking projection 64 of the elastic piece 63 is locked to the surface of the slip-off prevention projection 27. The female connector 30 is supported for elastic displacement along the bottom wall 20A of the connector-holding part 22, but is prevented from slipping off upward from the connector-holding part 22. The electric wire W is led to the outside through the cutout 23 of the lower cover 20 and an electric wire port.

The tapered rib 65 on the underside of each locking projection 64 slides on the projected edge of the slip-off prevention projection 27 in a direction from the lower side thereof to the higher side thereof. Thus the elastic piece 63 undergoes a smooth elastic deformation. More specifically, the rib 65 functions as the guide for elastically deforming the elastic piece 63 and as the means for reinforcing the locking projection 64. As described above, the connector-holding part 22 holds the female connector 30 below the upper end of the periphery of the lower cover 20 and thus the female connector 30 does not project out from the lower cover 20.

The lower cover 20 supports a pair of the female connectors 30 in a wait state, as shown with the arrow of FIG. 1, so that the body 11 of the electrical connection box 10 is mounted on the lower cover 20 from above. Initially, as shown in FIG. 4, the leading end of each guide rib 15 is inserted into the positioning groove 25 to place the body 11 and the lower cover 20 in position. At this time, the female connector 30 and the connector connection part 13 are spaced from each other.

Figure 5:
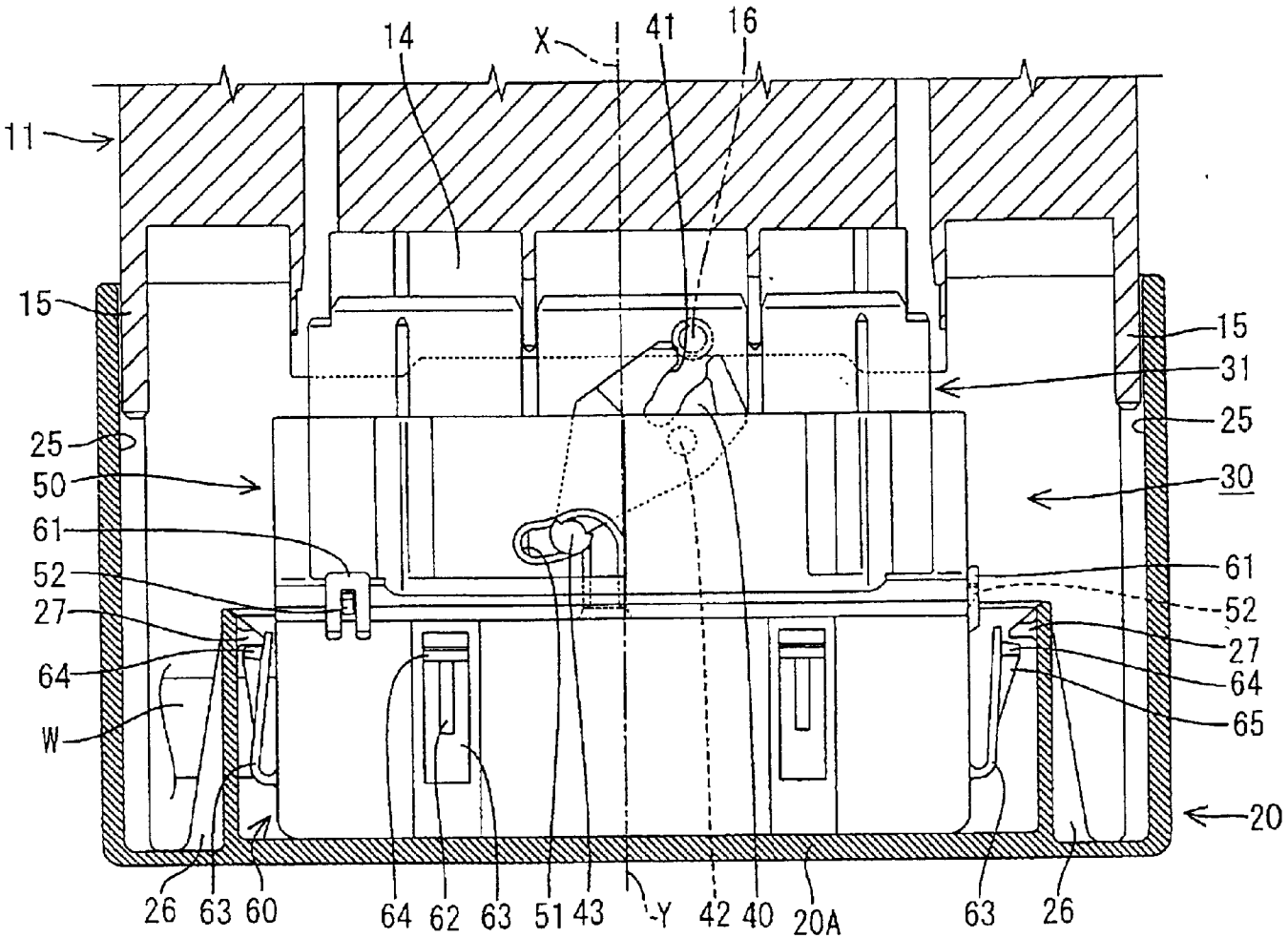
FIG. 5 is a side view partly in section showing a state in which the female connector and the connector connection part are aligned with each other.

The body 11 is moved toward the lower cover 20 in this state, and the guide rib 15 is inserted deep into the positioning groove 25. In this manner, the body 11 and the lower cover 20 are placed horizontally placed in position and approach each other in a tilting-prevented state. There is a possibility that the lower end of the connector connection part 13 will not align properly with the female connector 30 as they move in contact with each other. For example, as shown in FIG. 4, let it be supposed that the axis X of the connector connection part 13 is dislocated rearward (left-hand side in FIG. 4) from the axis Y of the female connector 30. When the leading end of the connector connection part 13 and that of the female housing 31 are butted against each other, the rear elastic piece 63 deforms elastically and the female connector 30 shifts rearward slidably on the bottom wall 20A, as shown in FIG. 5. In this manner, the connector connection part 13 and the female connector 30 are aligned with each other.

The connector connection part 13 is pressed further into the holder 50 so that the right and left follower pins 16 are disposed at the entrance of the cam grooves 41 of the corresponding levers 40. The female housing 31 then is pressed into the holder 50 so that the lever 40 is rotated. As a result, the connector connection part 13 is moved toward the female housing 31 by the action of levers between the cam grooves 41 and the follower pins 16. In this manner, the female connector 30 and the connector connection part 13 fit normally on each other (see FIG. 6). The connector connection parts 13 are arranged symmetrically in the right-to-left direction (longitudinal direction of the body 11). Therefore, a force can be applied uniformly to both connector connection parts 13.

On the other hand, the axis X of the connector connection part 13 may be dislocated forward from the axis Y of the female connector 30. In this case, the front elastic piece 63 deforms elastically and the female connector 30 shifts forward slidably to align the connector connection part 13 and the female connector 30 with each other. The axis X of the connector connection part 13 and the axis Y of the female connector 30 could be dislocated from each other in the right-to-left direction. In this case, the left-hand elastic piece 63 or the right-hand elastic piece 63 deforms elastically and the female connector 30 shifts slidably in the right-to-left direction to align the connector connection part 13 and the female connector 30 with each other.

As described above, the female connector 30 is mounted initially in the wait state. As a result, the mounting of the lower cover 20 on the body 11 connects the female connector 30 to the connector connection part 13 of the body 11. Thus, the lower cover 20 can be mounted on the body 11 with a high efficiency.

Both the body 11 and the lower cover 20 are large molded products, and it is difficult to obtain a high precision in mounting the lower cover 20 on the body 11. Thus, there is a possibility that the female connector 30 and the connector connection part 13 could be misaligned from each other. But, according to the embodiment, the elastic piece 63 supports the female connector 30 for elastic displacement. Thus, the female connector 30 shifts to correct any misalignment between the female connector 30 and the connector connection part 13. Therefore the lower cover 20 can be mounted on the body 11 easily.

The electric wire cover 60 with the elastic piece 63 is provided at the lower portion of the female housing 31 and slidably contacts the bottom wall 20A of the lower cover 20. The female connector 30 in the wait state and the connector connection part 13 may be dislocated from each other while mounting the lower cover 20 on the body 11 of the electrical connection box. However, the female connector 30 shifts elastically along the bottom wall 20A of the lower cover 20, thus absorbing the dislocation. Therefore the lower cover 20 can be mounted on the body 11 easily.

Known panel-mounted connector have self-aligning mechanisms for absorbing a dislocation between connectors. The panel-mounted type connector is supported, with the connector penetrating through a mounting hole formed on a panel and displaceable vertically and horizontally through an elastic piece. When the connector fits on a mating connector, the elastic piece deforms and absorbs the dislocation between the connectors.

However, if the supporting construction of the panel-mounted connector is used for the connector of the electrical connection box, the connector would be supported elastically with the connector penetrating through an opening formed on a bottom wall of a lower cover. In this case, water that has leaked up from a portion below the electrical connection box splashes on the connector or penetrates into the lower cover from the opening of the bottom wall, which is undesirable.

On the other hand, according to the invention, it is unnecessary to form a through-hole on the bottom wall 20A of the lower cover 20. Thus, it is possible to prevent water from splashing on the female connector 30.

Connection between the female connector 30 and the connector connection part 13 starts after the body 11 of the electrical connection box and the lower cover 20 are placed in position by the guide means (guide rib 15 and the positioning groove 25). Therefore the connection between the female connector 30 and the connector connection part 13 can be accomplished reliably.

The female connector 30 does not project outside from the lower cover 20 when the female connector 30 is mounted on the connector holding part 22 of the lower cover 20. Thus the female connector 30 can be protected.

Moreover plural connector connection parts 13 are disposed symmetrically on the lower surface of the body 11 of the electrical connection box. Therefore, it is possible to apply a uniform force to both connector connection parts 13 during mounting and to prevent the body 11 from inclining longitudinally.

The technical scope of the present invention is not limited to the above-described embodiment, but the modes which are described below is included in the technical scope of the present invention.

The present invention is applicable to the case in which a male connector is mounted on the lower cover.

According to the present invention, it is possible to provide a desired number of wait-side connectors and to provide some of the wait-side connectors or all of them with the self-aligning mechanism of the present invention.

What is claimed is:

1. An electrical connection box comprising:

a body having upper and lower surfaces, a connector connection part formed on the lower surface;

a connector provided at an end of an electric wire and connectable to said connector connection part (13);

a lower cover mounted on said body and covering the lower surface of said body, said lower cover having a connector-holding part capable of holding said connector; and an elastic member interposed between said connector and said connector-holding part to support said connector for elastic displacement, wherein said connector is placed in a wait state with said connector-holding part holding said connector and in consequence of mounting of said lower cover on said body, said connector is connected to said connector connection part.

2. The electrical connection box of claim 1, wherein an electric wire cover for laterally pulling out said electric wire is mounted on a lower portion of a housing of said connector; and a bottom surface of said electric wire cover is allowed to slide on a bottom wall of said lower cover, and said elastic member interposed between said electric wire cover and said connector-holding part is formed on a periphery of said electric wire cover so that said connector is supported for elastic displacement along said bottom wall of said lower cover.

3. The electrical connection box of claim 1, wherein a guide means for guiding an operation of mounting said lower cover on said body is provided on said lower cover and said body, and in mounting said lower cover on said body, a connection between said connector and said connector connection part starts after said body and said lower cover are placed in position by said guide means.

4. The electrical connection box of claim 1, wherein a height of a peripheral wall of said lower cover is set to accommodate an entire connector mounted on said connector-holding part.

5. The electrical connection box of claim 1, wherein on said lower surface of said body, a plurality of said connector connection parts are symmetrically disposed in a longitudinal direction of said body.

6. An electrical connection box comprising:

a body having upper and lower surfaces, a connector connection part formed on the lower surface thereof;

at least one connector assembly having a connector provided at an end of an electric wire and connectable to said connector connection part, a holder having a top opening for slideably receiving the connector in a forward position where the connector projects from the holder and in a rearward position where the connector is within the holder, a wire cover for engaging the holder and for guiding the wire from the connector; and a lower cover mounted on said body and covering the lower surface of said body, said lower cover having at least one connector-holding part capable of holding said connector assembly therein.

7. The electrical connection box of claim 6, further comprising resilient connection means between the connector holding part and the connector assembly for permitting the connector assembly to float relative to the lower cover for facilitating connection with the connector connection part.

8. The electrical connection box of claim 7, wherein the resilient connection means comprises elastic pieces formed unitarily with the wire cover.

9. The electrical connection box of claim 8, further comprising guide ribs formed on the elastic pieces for guiding the connector assembly into the connector-holding part of the lower cover.

10. The electrical connection box of claim 9, wherein the wire cover has a substantially solid bottom wall for enclosing said wire and said connector.

11. The electrical connection box of claim 10, wherein connector-holding part has a continuous side wall extending up from a bottom wall of the lower cover, the bottom wall of the wire cover slideably disposed on the bottom wall of the lower cover.

* * * * *